US008795507B2

(12) United States Patent
Ruan et al.

(10) Patent No.: US 8,795,507 B2
(45) Date of Patent: Aug. 5, 2014

(54) APPARATUS AND METHOD FOR IMPROVING MAGNETO-HYDRODYNAMICS STABILITY AND REDUCING ENERGY CONSUMPTION FOR ALUMINUM REDUCTION CELLS

(75) Inventors: Yimin Ruan, Pittsburgh, PA (US); Edwin A. Kuhn, Evansville, IN (US); J. Stephen Ubelhor, Evansville, IN (US); Donnie J. Duke, Henderson, KY (US)

(73) Assignee: Alcoa Inc., Pittsburgh, PA (US)

( * ) Notice: Subject to any disclaimer, the term of this patent is extended or adjusted under 35 U.S.C. 154(b) by 216 days.

(21) Appl. No.: 13/419,990

(22) Filed: Mar. 14, 2012

(65) Prior Publication Data

US 2013/0032486 A1 Feb. 7, 2013

Related U.S. Application Data

(60) Provisional application No. 61/515,396, filed on Aug. 5, 2011.

(51) Int. Cl.
*C25C 3/08* (2006.01)
*C25C 7/00* (2006.01)

(52) U.S. Cl.
CPC .. *C25C 3/08* (2013.01); *C25C 7/005* (2013.01)
USPC ..... 205/376; 205/372; 204/247.1; 204/245

(58) Field of Classification Search
None
See application file for complete search history.

(56) References Cited

U.S. PATENT DOCUMENTS 4,270,993 A * 6/1981 Arita ..... 205/374
4,411,747 A 10/1983 Dawless et al.
4,425,200 A * 1/1984 Arita ..... 205/339
4,436,598 A 3/1984 Tabereaux et al.
4,631,121 A 12/1986 Stewart et al.
4,737,254 A 4/1988 Geising et al.
4,919,782 A 4/1990 Stewart
5,062,929 A 11/1991 Hudson et al.

(Continued)

FOREIGN PATENT DOCUMENTS

CN 201367467 Y 12/2009
CN 101768759 B 9/2010
WO 2010148608 A1 12/2010

OTHER PUBLICATIONS

Davidson, P.A., Magnetohydrodynamics in Materials Processing, Annual Review of Fluid Mechanics, vol. 31, pp. 273-300, 1999.*

(Continued)

*Primary Examiner* — Harry D Wilkins, III
(74) *Attorney, Agent, or Firm* — Greenberg Traurig, LLP

(57) ABSTRACT

An apparatus and method for smelting has a smelting pot for containing electrolyte, alumina and a layer of liquid aluminum. A wall in the form of one or more $TiB_2$ or alumina plates extends from the bottom of the pot to a height exceeding the height of the liquid aluminum layer formed in the bottom of the smelting pot during smelting. The wall partitions the bottom of the pot and impedes movement of the aluminum under the influence of MHD forces, diminishing the maximum crest height of waves in the aluminum and allowing a reduction in the ACD to reduce electrical resistance and power consumption. The wall may equal or exceed the height of the anode and may, when conductive, act as a cathode, drawing a horizontal current. The wall may be composed of alumina, e.g., in the form of blocks, undergoing electrolytic reduction and being replaced periodically.

27 Claims, 6 Drawing Sheets

(56) References Cited

U.S. PATENT DOCUMENTS

| | | | | |
|---|---|---|---|---|
| 5,135,621 | A | 8/1992 | Nora et al. | |
| 5,286,359 | A | 2/1994 | Richards et al. | |
| 5,472,578 | A * | 12/1995 | de Nora | 205/372 |
| 5,667,664 | A * | 9/1997 | Juric et al. | 205/372 |
| 5,865,981 | A * | 2/1999 | de Nora | 205/372 |
| 6,245,201 | B1 | 6/2001 | Rendall | |
| 6,485,628 | B1 | 11/2002 | Brown et al. | |
| 6,558,525 | B1 * | 5/2003 | Bradford et al. | 205/380 |
| 2010/0294671 | A1 * | 11/2010 | Nguyen et al. | 205/375 |

OTHER PUBLICATIONS

International Search Report and Written Opinion of the International Searching Authority issued in connection with International Appln. No. PCT/US2012/048088 dated Sep. 28, 2012.

PCT International Preliminary Report on Patentability dated Feb. 11, 2014, on International Application No. PCT/US2012/048088 filed Jul. 25, 2012 and Written Opinion of the International Searching Authority dated Sep. 28, 2012.

Study on a New Reduction Technology for Energy Saving, Fengqin. L., et al., Light Metals 2010 TMS (The Minerals, Metals & Materials Society), 2010, pp. 387-389.

Phoenics Applications in the Aluminum Smelting Industry, Ch. Droste, VAW Aluminum-Technologie GmbH 53117 Bonn, Germany, 12 pages. PHOENICS Journal—Computational Fluid Dynamics and its Applications, vol. 13 No. 1 Jun. 2000.

Modeling Magnetohydrodynamics of Aluminum Electrolysis Cells With Ansys and CFX, Severo, D., et al., Light Metals 2005 TMS (The Minerals, Metals & Materials Society), 2005, 6 pages.

Analysis of Magnetohydrodynamic Instabilities in Aluminum Reduction Cells, M. Segatz, et al., VAW aluminum AG, 53117 Bonn, Germany, pp. 313-322. Light Metals, 1994.

* cited by examiner

APPARATUS AND METHOD FOR IMPROVING MAGNETO-HYDRODYNAMICS STABILITY AND REDUCING ENERGY CONSUMPTION FOR ALUMINUM REDUCTION CELLS

CROSS-REFERENCE TO RELATED APPLICATIONS

This application claims the benefit of U.S. Provisional Application Ser. No. 61/515,396 filed Aug. 5, 2011, the disclosure of which is incorporated herein by reference in its entirety.

FIELD

The present invention relates to apparatus and methods for smelting aluminum metal from alumina, and more particularly, to apparatus and methods for controlling magneto-hydrodynamic effects on the interface between the liquid electrolyte and the molten aluminum metal within a Hall-Héroult electrolytic reduction cell.

BACKGROUND

In the commercial production of aluminum, multiple Hall-Héroult electrolytic cells are utilized in a common receptacle or smelting "pot." Metallic aluminum is produced by the electrolysis of alumina that is dissolved in molten electrolyte (a cryolite "bath") and reduced by a high amperage electric current. The electric current passing through the conductors leading to the anodes, through the anodes, the electrolyte, the liquid metal (the metal "pad"), the cathode, and the conductors leading away from the cathode, creates strong electromagnetic forces (Lorentz forces) that physically agitate the liquid metal and the electrolyte, possibly causing waves—the magneto-hydrodynamic (MHD) effect.

SUMMARY

The disclosed subject matter relates to a smelting apparatus for electrolytically producing aluminum metal from alumina in a Hall-Héroult cell having an anode, a cathode, an electrolyte bath and a smelting pot for containing the electrolyte, alumina and a layer of liquid aluminum. The smelting pot has a bottom and sides and the liquid aluminum layer has a given height above the bottom of the smelting pot. A wall is disposed within the smelting pot defining sub-areas therein and extending at least a portion of at least one of the length and width of the smelting pot.

In accordance with another aspect of the disclosure, the wall has a height above the bottom of the smelting pot exceeding the given height of the aluminum layer in the smelting pot.

In accordance with another aspect of the disclosure, the wall has a height extending into the electrolyte bath.

In accordance with another aspect of the disclosure, during smelting, the height of the wall is above the lower surface of the anode, such that the anode is juxtaposed next to the wall but does not touch it.

In accordance with another aspect of the disclosure, the wall is capable of guiding molten aluminum moving under the influence of magnetic force along flow paths within the sub-area defined by the wall.

In accordance with another aspect of the disclosure, the wall defines at least 2 sub-areas within the smelting pot.

In accordance with another aspect of the disclosure, the wall is continuous.

In accordance with another aspect of the disclosure, the wall has a plurality of spaced sub-elements arranged in a pattern defining the wall.

In accordance with another aspect of the disclosure, the pattern is a line.

In accordance with another aspect of the disclosure, the wall extends parallel to a median line of the smelting pot.

In accordance with another aspect of the disclosure, an additional wall within the smelting pot defines additional subareas.

In accordance with another aspect of the disclosure, the additional wall is disposed approximately perpendicular to the first wall.

In accordance with another aspect of the disclosure, the wall increases a velocity of the electrolyte bath proximate to an alumina feed over that which is present in another area of the electrolyte bath during a smelting operation.

In accordance with another aspect of the disclosure, the velocity of the electrolyte bath increases the rate of distribution of the alumina in the electrolyte relative to that of a similar smelting pot without a wall.

In accordance with another aspect of the disclosure, the wall is composed at least partially of $TiB_2$ ($TiB_2C$).

In accordance with another aspect of the disclosure, the wall functions as a cathode upon which aluminum metal is deposited by electrolytic action.

In accordance with another aspect of the disclosure, the wall extends to a height proximate the anode and supports a horizontally oriented current between the wall and the anode.

In accordance with another aspect of the disclosure, the wall reduces the electrical resistance between the anode and cathode that would otherwise be present without the wall.

In accordance with another aspect of the disclosure, the spaced sub-elements are in the form of $TiB_2$ plates.

In accordance with another aspect of the disclosure, the plates are inserted into slots in the bottom of the smelting pot.

In accordance with another aspect of the disclosure, the wall is at least partially composed of alumina.

In accordance with another aspect of the disclosure, the wall is proportioned such that the wall persists during smelting as long as the anode of the cell persists.

In accordance with another aspect of the disclosure, the wall is in the form of alumina blocks.

In accordance with another aspect of the disclosure, a method for electrolytically producing aluminum metal from alumina in a Hall-Héroult cell having an anode, a cathode, an electrolyte bath and a smelting pot for containing the electrolyte, alumina and a layer of liquid aluminum, the smelting pot having a bottom and sides and the aluminum layer having a given height above the bottom of the smelting pot, includes inserting a wall within the smelting pot on the bottom thereof prior to electrolytically producing aluminum. The wall defines sub-areas within the smelting pot and extends at least a portion of at least one of the length and width of the smelting pot. The wall alters fluid flow of liquid aluminum attributable to the magneto-hydrodynamic effect when the aluminum is electrolytically produced and reduces peak wave height in the liquid aluminum relative to peak wave height in the smelting pot without the wall.

In accordance with another aspect of the disclosure, the wall is at least partially composed of $TiB_2$ and further including the step of conducting electricity through the wall to the cathode and depositing aluminum on the wall when aluminum is electrolytically produced.

In accordance with another aspect of the disclosure, the wall is at least partially composed of alumina and further including the steps of dissolving the wall into the electrolyte and reducing the alumina of the wall to aluminum metal.

In accordance with another aspect of the disclosure, the dimensions of the wall and the rate of dissolving the wall allows the wall to persist for a period of time approximating the useful life of the anode and further including the step of replacing a dissolved alumina wall with a new alumina wall when the anode is replaced with a new anode.

In accordance with another aspect of the disclosure, the wall alters fluid flow of the bath, improves alumina distribution and reduces the anode effect.

In accordance with another aspect of the disclosure, the step of altering fluid flow in the bath also reduces sludge formation.

BRIEF DESCRIPTION OF THE DRAWINGS

For a more complete understanding of the present invention, reference is made to the following detailed description of exemplary embodiments considered in conjunction with the accompanying drawings.

DETAILED DESCRIPTION OF EXEMPLARY EMBODIMENTS

Figure 1:
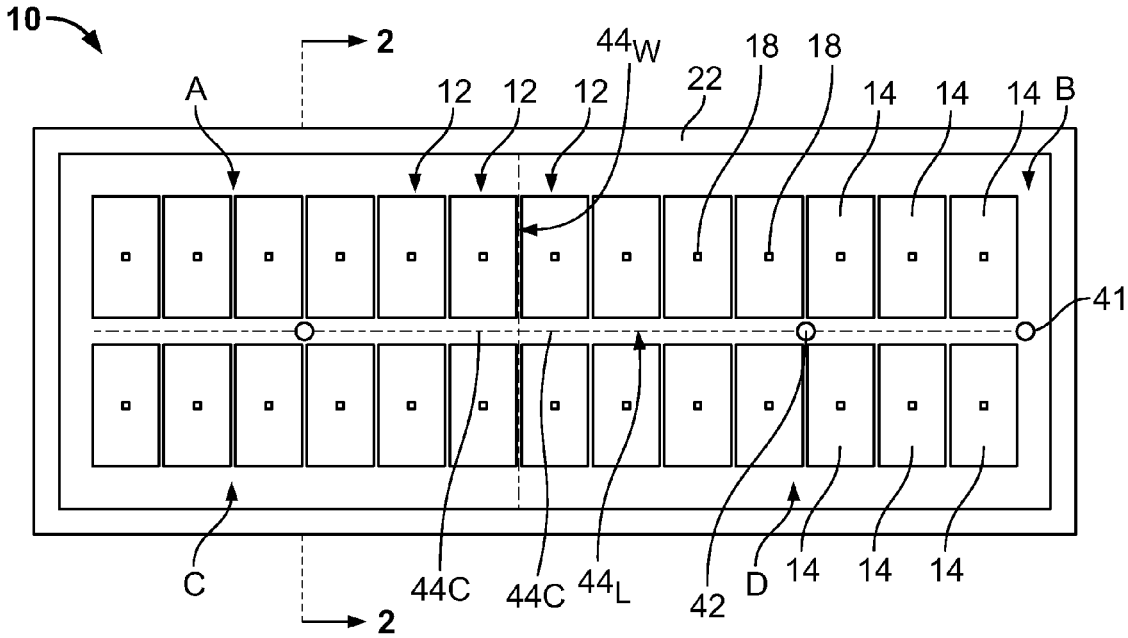
FIG. 1 is a diagrammatic, top view of a reduction cell for the electrolytic production of aluminum in accordance with an embodiment of the present disclosure.
Figure 2:
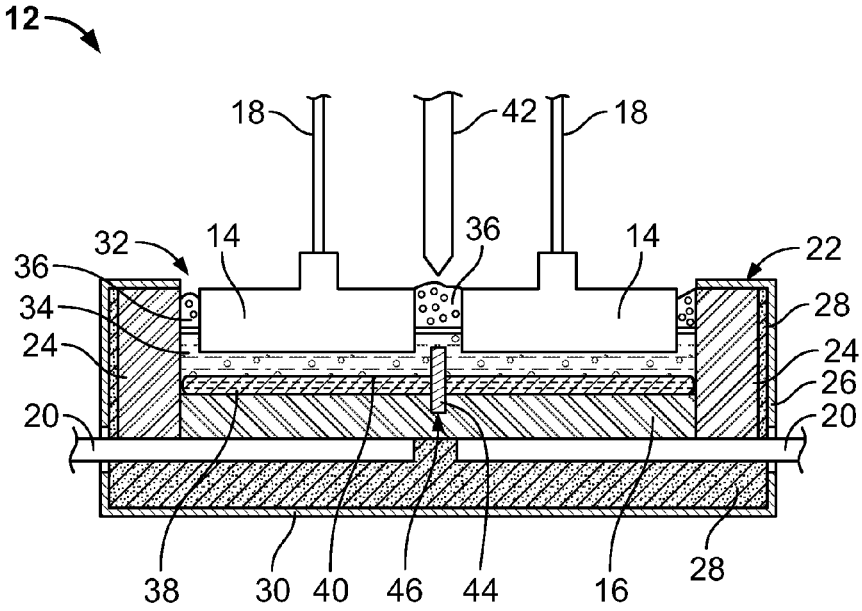
FIG. 2 is a diagrammatic, cross-sectional view of a battery of reduction cells like those shown in FIG. 1 within a common smelting pot to form a smelter, taken along section lines 2-2 and looking in the direction of the arrows.

FIGS. 1 and 2 show a smelter 10 for forming aluminum metal by the electrochemical reduction of alumina in a plurality of Hall-Héroult cells 12. The cells 12 utilize at least one anode 14 and a cathode 16 typically formed from carbon (graphite). An electrical potential, e.g., 3 to 5 volts DC, is applied across the anodes 14 and cathode 16 by electrical conductors 18, 20 (busbars) leading to a source of electrical power, e.g., a generator/rectifier (not shown). The plurality of cells 12 may be electrically connected in series. The smelter 10 may feature a composite side wall 22 having an inner wall 24 of heat resistant material, such as graphite, an outer side wall 26, e.g. made from steel and an intermediate layer of insulation 28. The insulation layer 28 may also be provided between the cathode 16 and a bottom steel wall 30. The cathode 16 and the inner wall 24 may conjointly form a common reservoir or pot 32. In the Hall-Héroult process, aluminum is produced by the electrolytical reduction of aluminum oxide ($Al_2O_3$), dissolved in molten electrolyte (mainly cryolite). As shown in FIG. 2, the electrolyte is present in two phases, viz., a molten, liquid phase 34 and a solid phase 36. The liquid phase 34 of electrolyte is often referred to as a "bath." A layer of liquid aluminum metal 38 is deposited on the cathode 16 and is separated from the liquid electrolyte 34 by a greater density, at an interface 40. Typically, the electrolyte 34 is kept in a liquid state by the heat generated by the electrical resistance to the current passing through the anode 14, the electrolyte 34, the liquid aluminum 38 and the cathode 16. The electrolyte 36 further away from these sources of heat solidifies into a solid crust.

As the electric current flows through the cell 12, oxygen bearing ions present in the alumina/electrolyte solution are discharged electrolytically at the anodes 14, accompanied by consumption of the carbon anode and generation of $CO_2$ gas. A hood, ducts and scrubber (not shown) are typically provided, e.g., at a duct end of the smelting pot 32, to capture off gases. The aluminum 38 formed by the electrolytic reduction reaction accumulates on the bottom of the pot 32 from which it is periodically suctioned at tap 41, e.g., at a tap end of the smelting pot 32. A feed 42, which is typically associated with a punch to penetrate the crust of electrolyte 36, is utilized to add additional alumina to maintain a continuous production of aluminum metal from the cell 12. A current of several hundred thousand Ampere is typically used in Hall-Héroult cells. As this strong current passes through the multiple adjacent cells 12 of a smelter 10 and through the conductors 18, 20 that conduct the electrical power to and from the cells 12, strong electromagnetic forces are generated, causing the MHD effect and disturbing the metal 38, the liquid electrolyte 34 and the interface 42 there between, which would otherwise be flat and horizontal.

A large portion of the electrical power consumed by the smelting process is expended in electrical conduction through the liquid electrolyte 34 layer, which exhibits high resistivity. The resistance to the flow of electricity through the electrolyte 34 is dependent upon the distance the current must travel through the electrolyte 34 between the anode 14 and the cathode 16, i.e., by the anode-cathode distance or ACD. The ACD is controlled automatically, e.g., by automatically repositioning the anode to compensate for anode consumption and varies only slightly during stable electrolysis. As a general rule, since the resistance and energy used increases with increasing ACD, the ACD is preferably minimized. The ACD is however required to be large enough such that the waves induced in the metal layer 38 and the electrolyte by the MHD effect are not of sufficient magnitude to cause disruption in the electrolytic process, e.g., by creating a short circuit due to a wave crest in the aluminum 38 contacting an anode 14.

FIGS. 1 and 2 illustrate a barrier/wall 44 in accordance with the present disclosure that is used to reduce the peak wave crests that arise in the liquid aluminum layer 38 due to the MHD effect. The wall 44 extends into the electrolyte 34/metal 38 (pad) interface, destroying the continuity of waves that would otherwise be present. This interruption of waves at the electrolyte 34/metal 38 (pad) interface stabilizes the pot 32 and allows a reduction of ACD. The wall 44 may be formed from a material that is resistant to chemical and thermal degradation in the environment of the cell 12, i.e., in the presence of molten electrolyte and aluminum metal and strong electrical currents. For example, the wall 44 may be made from $TiB_2$ plates. The wall 44 may be in the form of one or a plurality of plates that may be inserted into slots 46 formed in the cathode 16, with the wall 44 extending up to a height in excess of the anticipated height of the liquid aluminum layer 38, across the interface 42 and into the liquid electrolyte 34. Alternatively, the wall 44 may be held in a mechanically interlocking relationship relative to the cathode 16, be adhered there by cement or held by fasteners, e.g., which extend through the cathode 16 and mechanically grip to the wall 44 via a threaded aperture. As a further alternative, the wall 44 may be provided with a stable foot which prevents tipping under the forces anticipated to be exerted by the MHD waves in the aluminum 38 and electrolyte 34.

As a further alternative, the wall 44 may be formed from alumina plates or blocks. A wall 44 made from alumina will gradually dissolve in the electrolyte 34, but may be dimensioned to maintain a wall structure for a given, predictable period of time. For example, a wall formed from alumina blocks may be dimensioned to persist in molten electrolyte for a period approximating the useful life of an anode. In this instance, the alumina blocks forming a wall 44 could be installed at the same time that a new anode 14 is installed, with the expectation of installing new alumina blocks forming a new wall 44 at the same time that a spent anode 14 is replaced by a new anode 14, e.g., after anode set. The dissolution of a wall 44 made from alumina has no negative effects on the function of the cell 12, which produces aluminum metal from alumina during normal operation.

While geometric equality is not required, in FIG. 1, the wall $\mathbf{44}_L$ shown divides the volume of the pot 32 longitudinally into two approximately equal areas (comprised of area A+B and C+D when viewed from the top) along the longitudinal axis of symmetry. The wall 44 may be continuous or may be formed from a plurality of barrier components $\mathbf{44}_C$ positioned adjacent to one another. The barrier components $\mathbf{44}_C$ in a composite wall 44 may have spaces there between without substantially diminishing the wave crest reduction effect. In either the case of a continuous wall 44 or one made from a plurality of sub-elements $\mathbf{44}_C$ having a spacing there between, the wall 44 subdivides the molten aluminum pad 38 and/or the electrolyte 34 in the pot 32 into sub-areas, e.g., A and C, having characteristic flows and waves in the aluminum attributable to the magneto-hydrodynamic effect, as well as characteristic peak wave heights in the pad 38, which may be different than that in a pot 32 without a wall or walls 44. In the case of a plurality of barrier components, e.g., $\mathbf{44}_C$ arranged in a line with spaces there between to form a wall $\mathbf{44}_L$, the resultant wall $\mathbf{44}_L$ forms a fluid guide to induce a flow pattern within the sub-areas defined by the wall $\mathbf{44}_L$, even though the spaces between the barrier components $\mathbf{44}_C$ would allow some flow of molten aluminum metal there between.

Additional walls $\mathbf{44}_W$ may be utilized to divide the pot 32 and the pad 38 into smaller sub-areas, e.g., a wall $\mathbf{44}_W$ could be extended across the width of the pot 32 to form four sub-areas A, B, C, D. Note that the wall 44W is closer to one end of the smelter 10 than the other, illustrating that subdivisions of the pot 32 volume other than precisely equal subdivisions are effective at reducing peak wave crests. As with wall $\mathbf{44}_L$, wall $\mathbf{44}_W$ may be formed as one continuous structure or may be made from a plurality of elements, which may have a spacing there between. A smelter 10 may be originally designed to accommodate one or more walls 44 or an existing smelter 10 may be retrofitted with a wall(s) 44.

Figure 3:
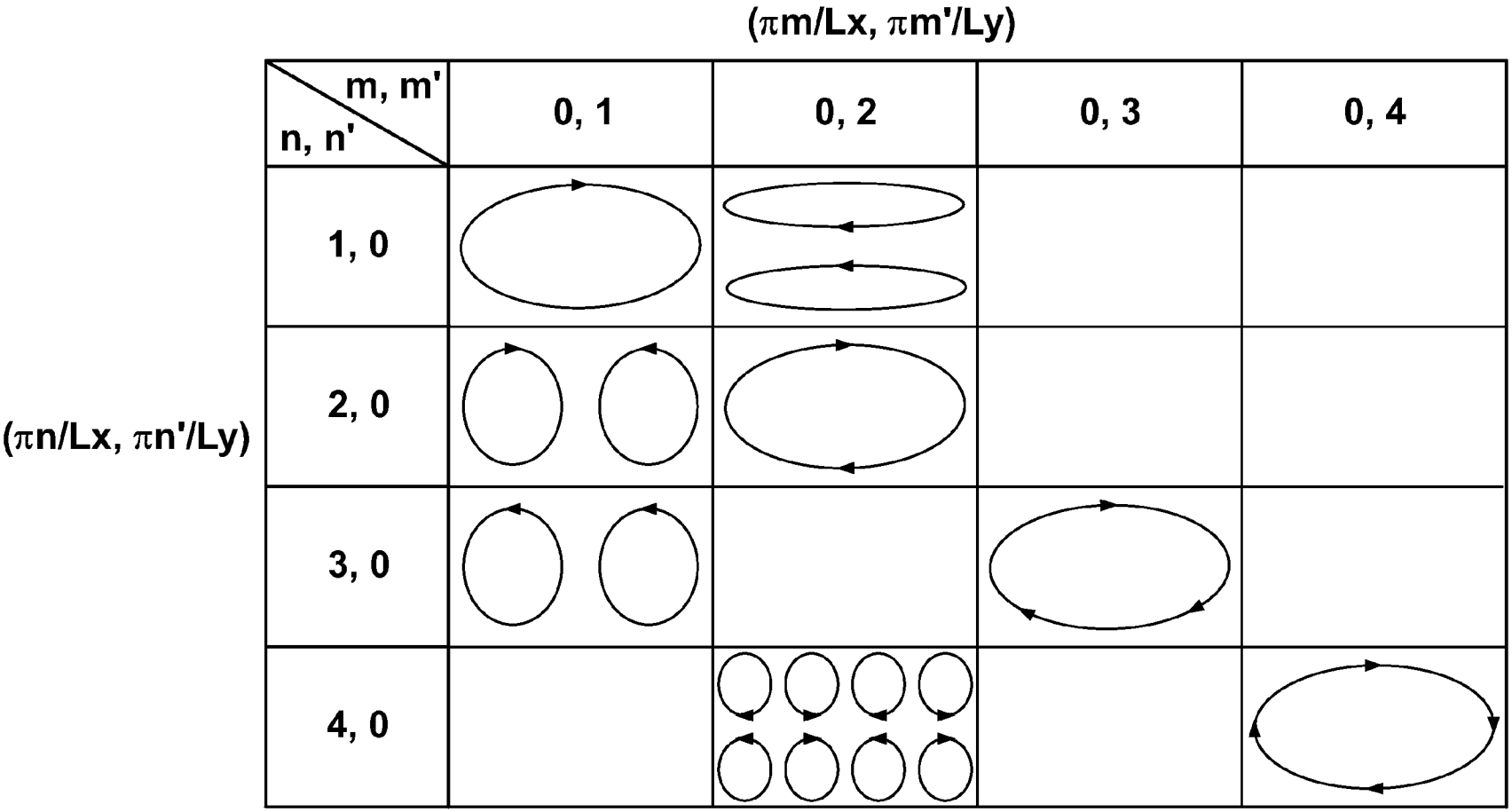
FIG. 3 is a diagram of potential wave crests associated with instability modes present in a smelting pot like that shown in FIG. 2, but wherein the smelting pot lacks a wall in accordance with the present disclosure installed therein, the arrows indicating the moving direction of the wave crests.

FIG. 3 illustrates the wave crests that can be expected in a smelting pot, as was known in the prior art and expressed in the article, "Analysis of Magneto-hydrodynamic Instabilities in Aluminum Reduction Cells," by M. Segatz and C. Droste, Light Metals, 1994.

Using MHD computer modeling, the following data can be generated describing the stability parameters (s.p.) growth rate (g.r.), frequency and period of waves anticipated to occur in an existing commercial production smelting pot known as an Alcoa P100 and having pot cavity dimensions of 7798 mm×2651 mm. The following values assume an ACD of 38 mm, a current load of 128 kA at about 4.5 V and a liquid aluminum metal depth of 102 mm.

| s.p. (g.r.) | Frequency | Period |
|---|---|---|
| 0.0049 | 0.49 | 12.7 |
| 0.0135 | 0.44 | 14.3 |
| 0.0171 | 0.39 | 16.2 |
| 0.0214 | 0.33 | 19.1 |
| 0.0279 | 0.27 | 23.3 |
| 00308 | 0.23 | 27.4 |
| 0.0913 | 0.20 | 31.7 |

Figure 4:
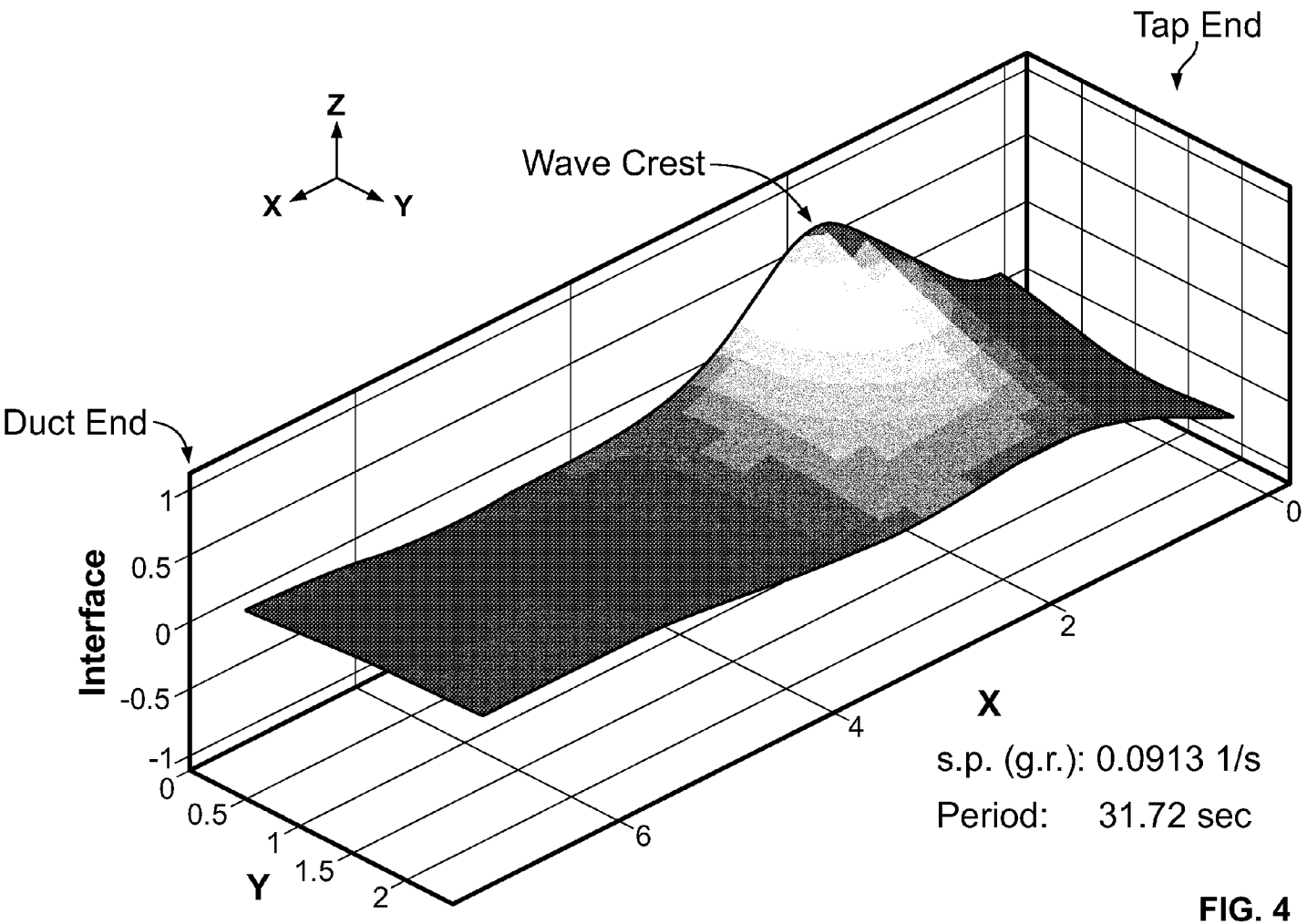
FIG. 4 is a diagrammatic view of a wave crest developed in the liquid metal present in a smelting pot which lacks a wall in accordance with the present disclosure installed therein.

FIG. 4 graphically illustrates a wave crest of the most unstable mode from the above modelling, viz., the wave crest associated with the period 31.7. The present disclosure recognizes that the amplitude of the maximum wave crest attributable to MHD instabilities is related to the ACD, the length and width dimensions of the smelting pot, the depth and the uninterrupted surface area of the liquid aluminum layer 38 (which for reference may be measured in a rest state without the presence of MHD instabilities) and interface 42. Further, that partitioning the liquid metal and part of the liquid electrolyte contained in the pot 32 with a wall 44 can impede the movement of liquid metal under the influence of MHD forces (Lorenz forces), eliminating various unstable modes, reducing maximum wave crest magnitude and allowing a reduction in ACD, thus reducing electrical resistance and power consumption.

Figure 5:
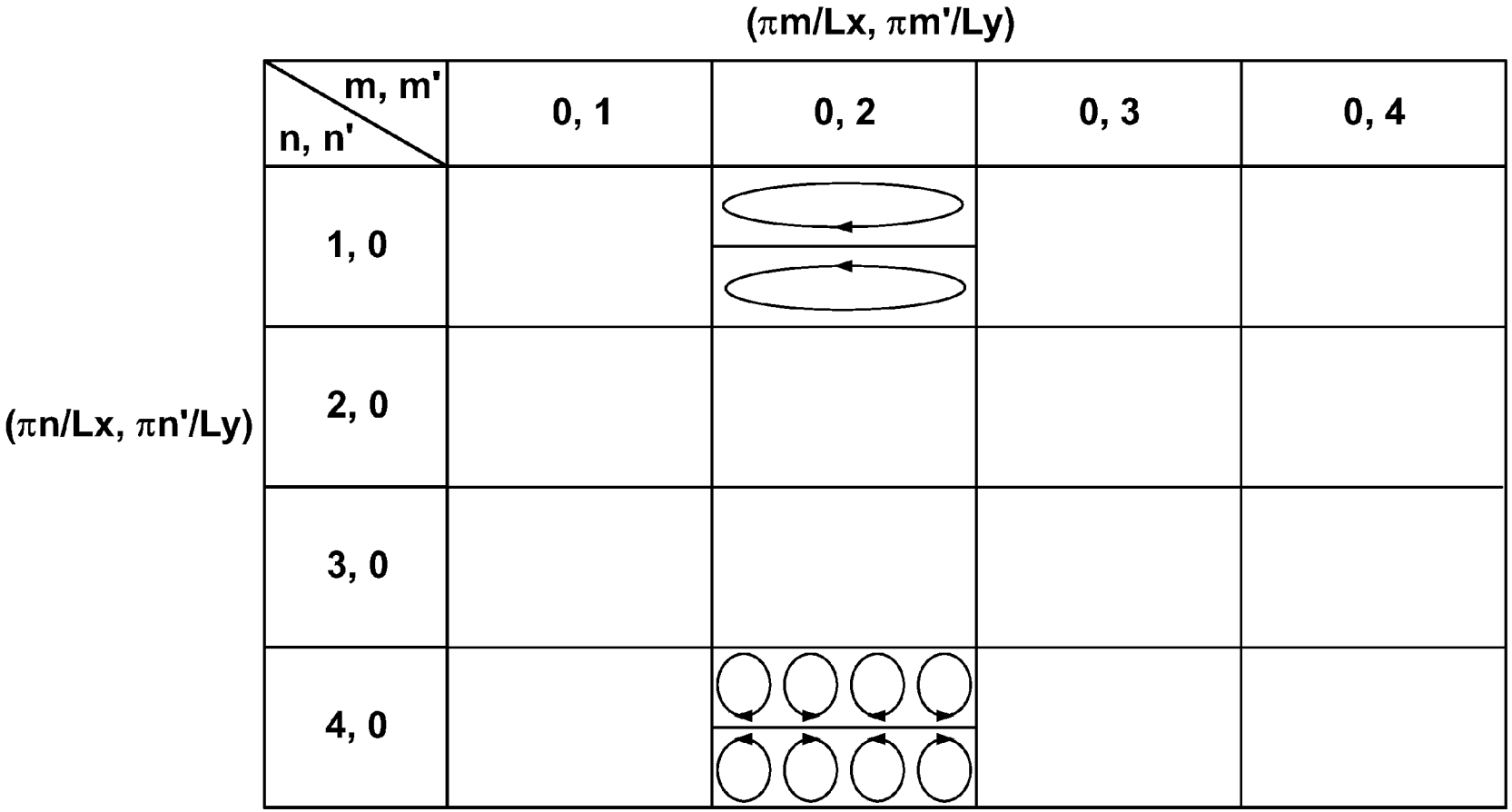
FIG. 5 is a diagram of potential wave crests associated with instability modes present in a smelting pot like that shown in FIG. 2, with a wall of the present disclosure installed in the smelting pot.

FIG. 5 illustrates wave crests like FIG. 3, but in this figure, the wave crests shown are those present when a wall 44 is installed in the pot 32, dividing the volume of the pot. As can be appreciated in FIG. 5, the waves of many previous unstable modes have been eliminated as compared to FIG. 3

The following are modelled values of the most unstable modes associated with smelting pots 32 having a wall 44 in accordance with the present disclosure, the wall having the configuration indicated below and smelting being conducted using the stated ACD, all conducted relative to a smelting pot having pot dimensions: 7798 mm×2651 mm running an electrical load of 128 kA at 4.5 V and an average liquid aluminum depth of 102 mm.

Two centrally oriented perpendicular walls $\mathbf{44}_L$ and $\mathbf{44}_W$

| ACD | Subarea | s.p. (g.r.) | Period |
|---|---|---|---|
| 38 mm | A | 0.003393 1/sec | 8.078 sec |
| " | B | 0.00495 1/sec | 5.429 sec |
| " | C | 0.003145 1/s | 7.099 sec |
| " | D | 0.007379 1/s | 5.477 sec |

One longitudinal wall $\mathbf{44}_L$

| ACD | Subarea | s.p. (g.r.) | Period |
|---|---|---|---|
| 38 mm | A + B | 0.007800 1/sec | 13.79 sec |
| " | C + D | 0.007035 1/sec | 15.57 sec |
| 28 mm | A + B | 0.01160 1/sec | 17.68 sec |
| " | C + D | 0.007035 1/sec | 15.57 sec |
| 20 mm | A + B | 0.02142 1/sec | 22.15 sec |
| " | C + D | 0.0698 1/sec | 24.43 sec |

The foregoing illustrates that the use of a wall 44 in a pot 32 can result in a reduction of ACD from 40 mm to 30 mm resulting in an estimated voltage reduction of about 0.5 V.

Instead of a savings attributable to the use of less electrical power, the smelter operator may prefer to increase the load for greater production, e.g., a 5-10% load increase using the same amount of electrical power.

Figure 6:
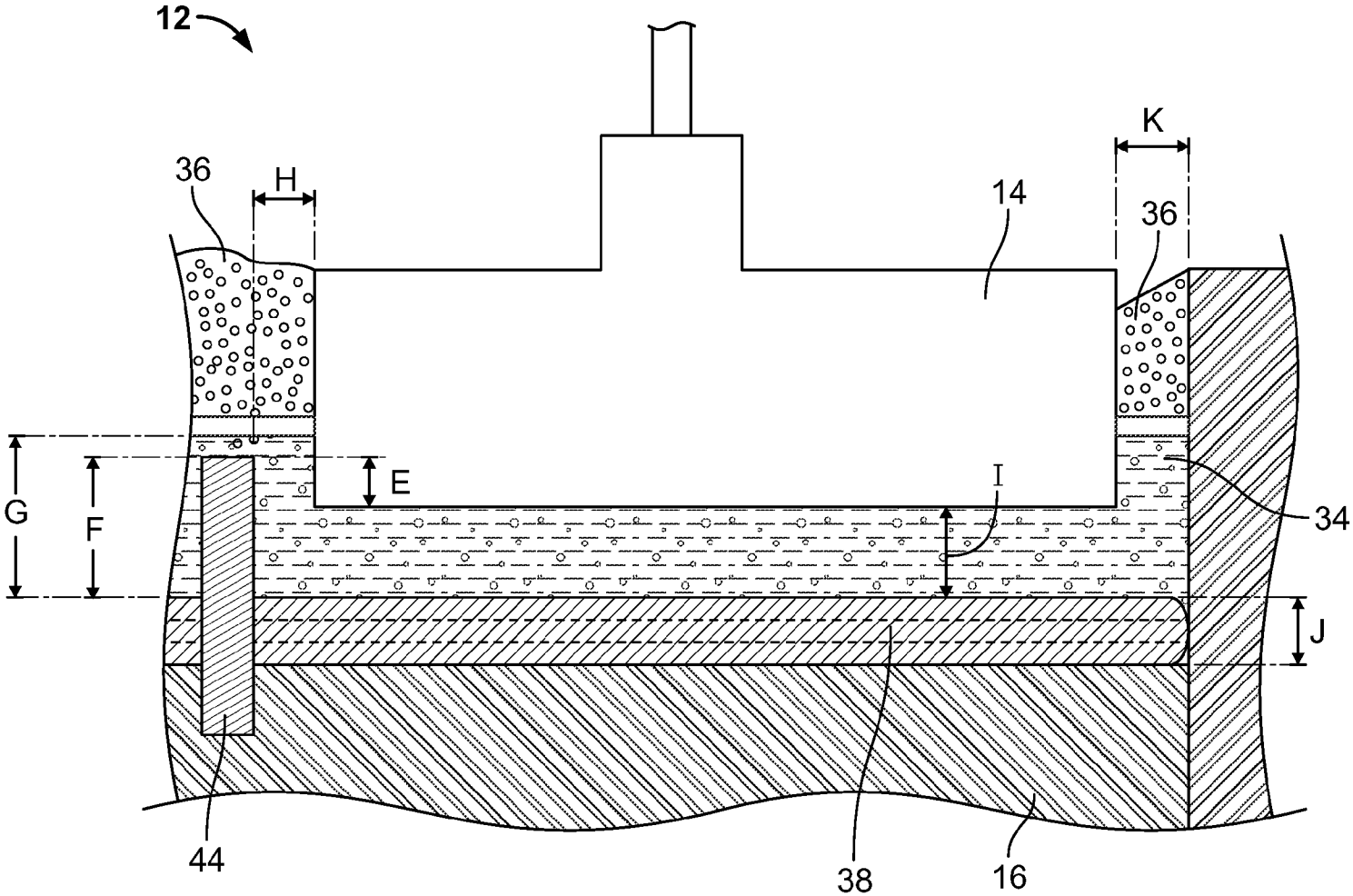
FIG. 6 is a diagrammatic cross-sectional view of a portion of a reduction cell for the electrolytic production of aluminum in accordance with an embodiment of the present disclosure.

FIG. 6 shows exemplary dimensions within a cell 12 in accordance with an embodiment of the present disclosure. The traditional measure of anode-to-cathode distance (ACD) is designated I, which, may be, e.g., 20 mm to 40 mm. The "cathode" in measuring the distance I includes the liquid aluminum layer or "pad" 38, which has a thickness designated J, which may be on average, e.g., 102 mm. The wall 44 extends through the pad 38 into the electrolyte 34, to a height F above the pad 38, of about 0 to about 15 cm. Optionally, the anode-to-cathode distance I may be less than the height of the wall F, by an amount E. The wall 44 is lower than the height G of the electrolyte 34, which may be, e.g., about 15 cm to about 18 cm. The distance H from the anode 14 to the wall 44 may be, e.g., about 5 cm to about 10 cm. If the wall 44 is made from electrically conductive material, e.g., $TiB_2$ plates, the distance H may be described as the horizontal anode-to-cathode distance (HACD), as further explained below. Due to the proximity of the wall 44 to the anode 14, and the electrical continuity between the wall 44 (if made from an electrical conductor like $TiB_2$) and the cathode 16, a portion of the electric current passing from the anode 14 to the cathode 16 passes through the wall 44. In this instance, the wall 44 functions electrically as part of the cathode 16. As a result, alumina is reduced at the wall 44 producing a deposit of aluminum metal on the wall 44. The deposited aluminum metal coats the wall 44, shielding the wall 44 from the corrosive effects of the electrolyte 34. For any given current passing through the cell 12, because a portion of the current flow is in the horizontal direction—across the gap H, the current in the vertical direction (across gap I) is lessened relative to that which would occur if there was no current in the horizontal direction. This relatively reduced current in the vertical direction reduces the magneto hydrodynamic effect associated with currents in a vertical direction and produces magneto-hydrodynamic motion associated with the horizontal current flow. This division of current flow into perpendicular components reduces the total resistance, as well as the maximum wave height which would otherwise exist where the current traverses the cell in a single direction. As noted above, the wall 44 may be made from alumina, e.g., in the form of alumina blocks. Alumina is consumable in the Hall-Héroult process. A wall 44 made from alumina would not conduct electricity and therefore would not support a horizontal current or constitute a substrate where alumina is reduced to aluminum metal. A wall 44 made from alumina, e.g., alumina blocks, may be proportioned to dissolve in a half anode set cycle, whereupon new alumina blocks can be inserted between the anodes 14 of adjacent cells 12. Regardless of the material used to make the wall 44, a spacing between sub-elements $\mathbf{44}_C$ may be provided proximate taps 41 or feeds 42 to insure a mechanical clearance to allow tapping and feeding to occur without encountering and/or damaging the wall 44 with tap or feed apparatus.

Figure 7:
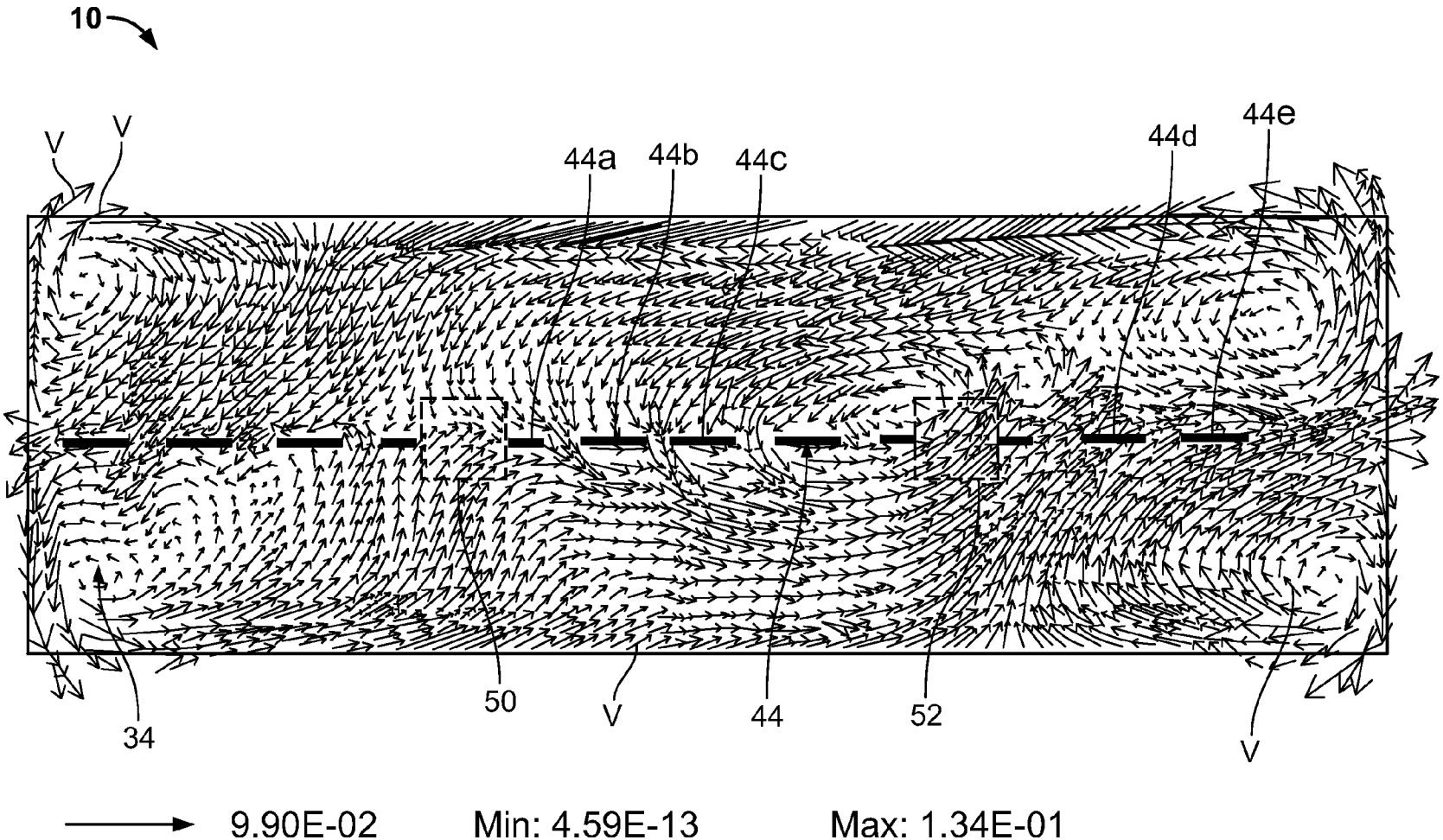
FIG. 7 is a diagrammatic, top view of bath velocity in a reduction cell for the electrolytic production of aluminum in accordance with an embodiment of the present disclosure.

FIG. 7 shows flow velocity vectors V of an electrolyte bath 34 in a smelter 10 as computed by computer modelling. The bath velocity near the three barrier components 44*a*, 44*b*, 44*c* of the wall 44 is less than at barrier components 44*d* and 44*e*. Two alumina feeds 50, 52 are shown diagrammatically by dashed rectangles. The modelling shows that the velocity of the electrolyte 34 is relatively higher proximate alumina feed 52 than at feed 50. Alumina fed to the smelter 10 at the feeds 50, 52 enters in powder form and drops down through the electrolyte 34. Optimally, the alumina dissolves in the electrolyte 34 before forming a sludge on the cathode 16, which diminishes smelter 10 performance. A pot with large sludge areas may be less stable and have diminished efficiency relative to a pot without substantial sludge accumulation. Better alumina distribution may reduce the anode effect, which consumes power unproductively and produces greenhouse gases, such as $CF_4$ and $C_2F_6$. The electrolyte 34 is agitated by the aluminum pad 38, which is agitated by magneto-hydrodynamic forces, which, notwithstanding their destabilizing affect, do agitate the electrolyte 34, which aids in distributing and dissolving in-fed alumina powder, preventing sludge formation. A higher velocity electrolyte 34 near either and/or both of the feeds 50, 52 therefore has a beneficial effect with regard to the increased rate of distribution and dissolution of alumina in the electrolyte. Compared to a normal pot without a wall 44, the wall 44 may improve alumina distribution, e.g., by 10%, allowing for an increased rate of alumina distribution and dissolution, while simultaneously reducing the overall wave crest height of the metal pad 38, permitting a smaller ACD and greater energy efficiency. Better alumina distribution and dissolution may help to reduce the likelihood of anode effect and sludge formation at the bottom of the pot.

It will be understood that the embodiments described herein are merely exemplary and that a person skilled in the art may make many variations and modifications without departing from the spirit and scope of the claimed subject matter. All such variations and modifications are intended to be included within the scope of the appended claims.

We claim:

1. A smelting apparatus for electrolytically producing aluminum metal from alumina in a Hall-Héroult cell, comprising:

an anode;

a cathode;

an electrolyte bath;

a smelting pot for containing the electrolyte, alumina and a layer of liquid aluminum, the smelting pot having a bottom and sides and the aluminum layer having a given height above the bottom of the smelting pot; and a wall at least partially composed of alumina disposed within the smelting pot defining sub-areas therein and extending at least a portion of at least one of the length and width of the smelting pot.

2. The apparatus of claim 1, wherein the wall has a height above the bottom of the smelting pot exceeding the given height of the aluminum layer in the smelting pot.

3. The apparatus of claim 2, wherein the wall has a height extending into the electrolyte bath.

4. The apparatus of claim 3, wherein the wall functions as a cathode upon which aluminum metal is deposited by electrolytic action.

5. The apparatus of claim 4, wherein the wall extends to a height proximate the anode and supports a horizontally oriented current between the wall and the anode.

6. The apparatus of claim 5, wherein the wall reduces the electrical resistance between the anode and cathode that would otherwise be present without the wall.

7. The apparatus of claim 1, wherein during smelting, the height of the wall is above the lower surface of the anode, such that the anode is juxtaposed next to the wall but does not touch it.

8. The apparatus of claim 1, wherein the wall is capable of guiding molten aluminum moving under the influence of magnetic force along flow paths within the sub-area defined by the wall.

9. The apparatus of claim 8, wherein the wall defines at least 2 sub-areas within the smelting pot.

10. The apparatus of claim 1 wherein the wall is continuous.

11. The apparatus of claim 1, wherein the wall has a plurality of spaced sub-elements arranged in a pattern defining the wall.

12. The apparatus of claim 11, wherein the pattern is a line.

13. The apparatus of claim 11, wherein the spaced sub-elements are in the form of plates.

14. The apparatus of claim 13, wherein the plates are inserted into slots in the bottom of the smelting pot.

15. The apparatus of claim 1, wherein the wall extends parallel to a median line of the smelting pot.

16. The apparatus of claim 15, further comprising an additional wall within the smelting pot defining additional subareas.

17. The apparatus of claim 16, wherein the additional wall is disposed approximately perpendicular to the first wall.

18. The apparatus of claim 1, wherein the wall increases a velocity of the electrolyte bath proximate to an alumina feed over that which is present in another area of the electrolyte bath during a smelting operation.

19. The apparatus of claim 18, wherein the velocity of the electrolyte bath increases the rate of distribution of the alumina in the electrolyte relative to that of a similar smelting pot without a wall.

20. The apparatus of claim 1, wherein the wall is composed at least partially of $TiB_2$.

21. The apparatus of claim 1, wherein the wall is proportioned such that the wall persists during smelting as long as the anode of the cell persists.

22. The apparatus of claim 1, wherein the wall is in the form of alumina blocks.

23. A method for electrolytically producing aluminum metal from alumina in a Hall-Héroult cell having an anode, a cathode, an electrolyte bath and a smelting pot for containing the electrolyte, alumina and a layer of liquid aluminum, the smelting pot having a bottom and sides and the aluminum layer having a given height above the bottom of the smelting pot, comprising the steps of:

inserting a wall at least partially composed of alumina within the smelting pot on the bottom thereof prior to electrolytically producing aluminum, the wall defining sub-areas within the smelting pot and extending at least a portion of at least one of the length and width of the smelting pot, the wall altering fluid flow of liquid aluminum attributable to the magneto-hydrodynamic effect when the aluminum is electrolytically produced, the wall reducing peak wave height in the liquid aluminum relative to peak wave height in the smelting pot without the wall;

dissolving the wall into the electrolyte and reducing the alumina of the wall to aluminum metal.

24. The method of claim 23, wherein the wall is at least partially composed of $TiB_2$ and further comprising the step of conducting electricity through the wall to the cathode and depositing aluminum on the wall when aluminum is electrolytically produced.

25. The method of claim 23, wherein the dimensions of the wall and the rate of dissolving the wall allows the wall to persist for a period of time approximating the useful life of the anode and further comprising the step of replacing a dissolved alumina wall with a new alumina wall when the anode is replaced with a new anode.

26. The method of claim 23, further comprising the wall altering fluid flow of the bath, improving alumina distribution and reducing the anode effect.

27. The method of claim 26, wherein the step of altering fluid flow in the bath also reduces sludge formation.

* * * * *